US006105473A

United States Patent [19]

Huang

[11] Patent Number: 6,105,473

[45] Date of Patent: Aug. 22, 2000

[54] LOCK DEVICE FOR ROTATABLE TOOL DRIVING HEAD

[76] Inventor: Li Shiu Huang, No. 105, Tsu Ah Lane, Chong San Road, San Her Tsuen, Wu Zh Hsiang, Taichung Hsien 414, Taiwan

[21] Appl. No.: 09/376,388

[22] Filed: Aug. 18, 1999

[51] Int. Cl.[7] ..... B25B 13/00

[52] U.S. Cl. ..... 81/177.75; 81/177.8

[58] Field of Search ..... 81/177.2, 177.6, 81/177.8, 177.75, 177.7, 177.9, 124.5

[56] References Cited

U.S. PATENT DOCUMENTS 3,855,884 12/1974 McPeak ..... 81/177.75
4,065,941 1/1978 Aoki ..... 81/177.75 X
4,807,499 2/1989 Martinez ..... 81/177.75
4,936,701 6/1990 Allen et al. ..... 81/177.75 X
5,236,289 8/1993 Salyer ..... 81/177.75 X

*Primary Examiner*—David A. Scherbel
*Assistant Examiner*—Anthony Ojini
*Attorney, Agent, or Firm*—Charles E. Baxley

[57] ABSTRACT

A tool includes a driving head pivotally coupled to a tool member at a pivotal coupler, and a barrel slidably engaged on the tool member and slidable to engage onto the driving head and to lock the driving head to the tool member and to prevent the driving head from rotating relative to the tool member about the pivotal coupler. The driving head may be rotated relative to the tool member about the pivotal coupler when the barrel is disengaged from the driving head. A pin is rotatably engaged through a channel of the pivotal coupler which is extended from the tool member.

8 Claims, 4 Drawing Sheets

LOCK DEVICE FOR ROTATABLE TOOL DRIVING HEAD

BACKGROUND OF THE INVENTION

1. Field of the Invention

The present invention relates to a lock device, and more particularly to a lock device for locking the rotatably driving head of a tool.

2. Description of the Prior Art

Typical tools comprise a rotatable driving head pivotally coupled to a handle, and a locking device threaded to the handle and engageable with the driving head for locking the driving head to the handle and for preventing the driving head from rotating relative to the handle. However, it may take a relatively long time to rotate and thread the locking device relative to the handle and the driving head.

The present invention has arisen to mitigate and/or obviate the afore-described disadvantages of the conventional tool rotatable driving head locking devices.

SUMMARY OF THE INVENTION

The primary objective of the present invention is to provide a tool having a quick release lock device for quickly locking and unlocking the rotatable driving head of the tool relative to the handle.

In accordance with one aspect of the invention, there is provided a tool comprising a tool body including a first end, a driving head including a first end pivotally coupled to the first end of the tool body at a pivotal coupler, and a barrel slidably engaged on the tool body and slidable to engage onto the driving head to lock the driving head to the tool body and to prevent the driving head from rotating relative to the tool body about the pivotal coupler, and the driving head being allowed to be rotated relative to the tool body about the pivotal coupler when the barrel is disengaged from the driving head.

The driving head includes a first end having a chamber formed therein, the pivotal coupler includes a spherical body extended from the first end of the tool body and rotatably received in the chamber of the driving head for allowing the driving head to be rotated relative to the tool body. The spherical body of the pivotal coupler includes a channel formed therein, the driving head includes a pin secured in the first end thereof and engaged through the channel of the pivotal coupler for rotatably securing the driving head to the tool body. The channel of the pivotal coupler includes two enlarged end portions and a narrower middle portion for receiving the pin and for allowing the pin to be rotated relative to the pivotal coupler. The driving head includes an annular shoulder formed therein for engaging with the barrel and for limiting a relative movement of the barrel to the driving head.

The tool body includes a annular groove formed therein, and a retaining ring engaged on the annular groove of the tool body, the barrel includes an annular recess formed therein for receiving the retaining ring and for securing the barrel to the tool body. The barrel includes a tapered surface formed therein for engaging with the retaining ring and for facilitating an engagement and an disengagement of the retaining ring from the annular recess of the barrel. Another retaining ring may further be engaged on the tool body and engaged with the barrel for limiting a relative movement of the barrel to the tool body.

Further objectives and advantages of the present invention will become apparent from a careful reading of a detailed description provided hereinbelow, with appropriate reference to accompanying drawings.

4

Figure 4:
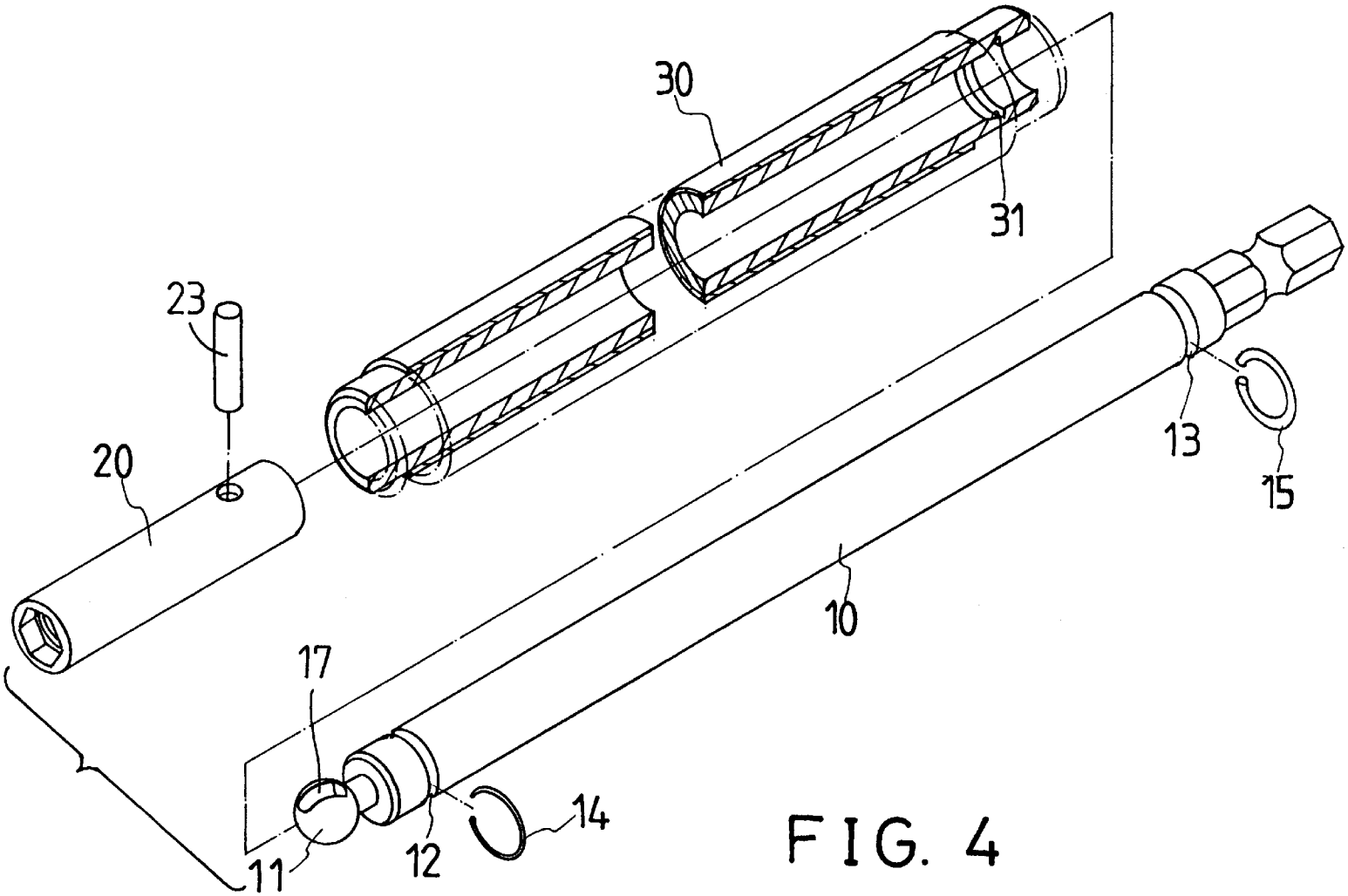
FIG. 4 is an exploded view illustrating another application of the tool.
Figure 5:
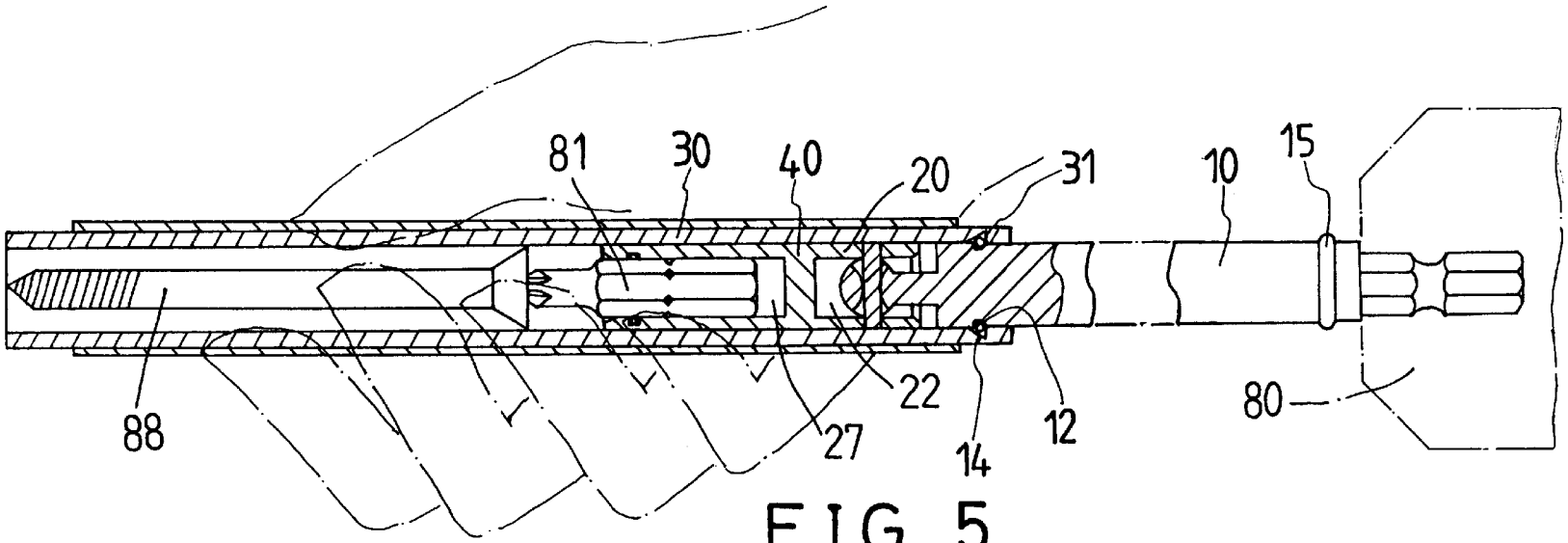
Figure 6:
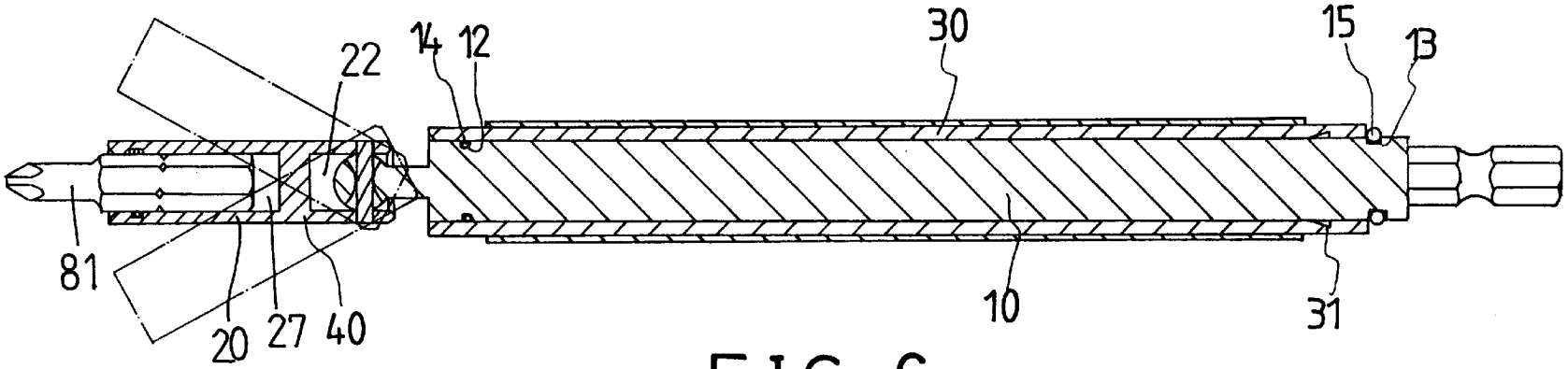

FIG. 5 is a cross sectional view of the tool as shown in FIG. 4, in which the driving head is locked to the handle or to the driving stem of the tool; and FIG. 6 is a cross sectional view of the tool as shown in FIGS. 4 and 5, in which the driving head may be rotated relative to the handle or the driving stem of the tool.

DETAILED DESCRIPTION OF THE PREFERRED EMBODIMENT

Figure 1:
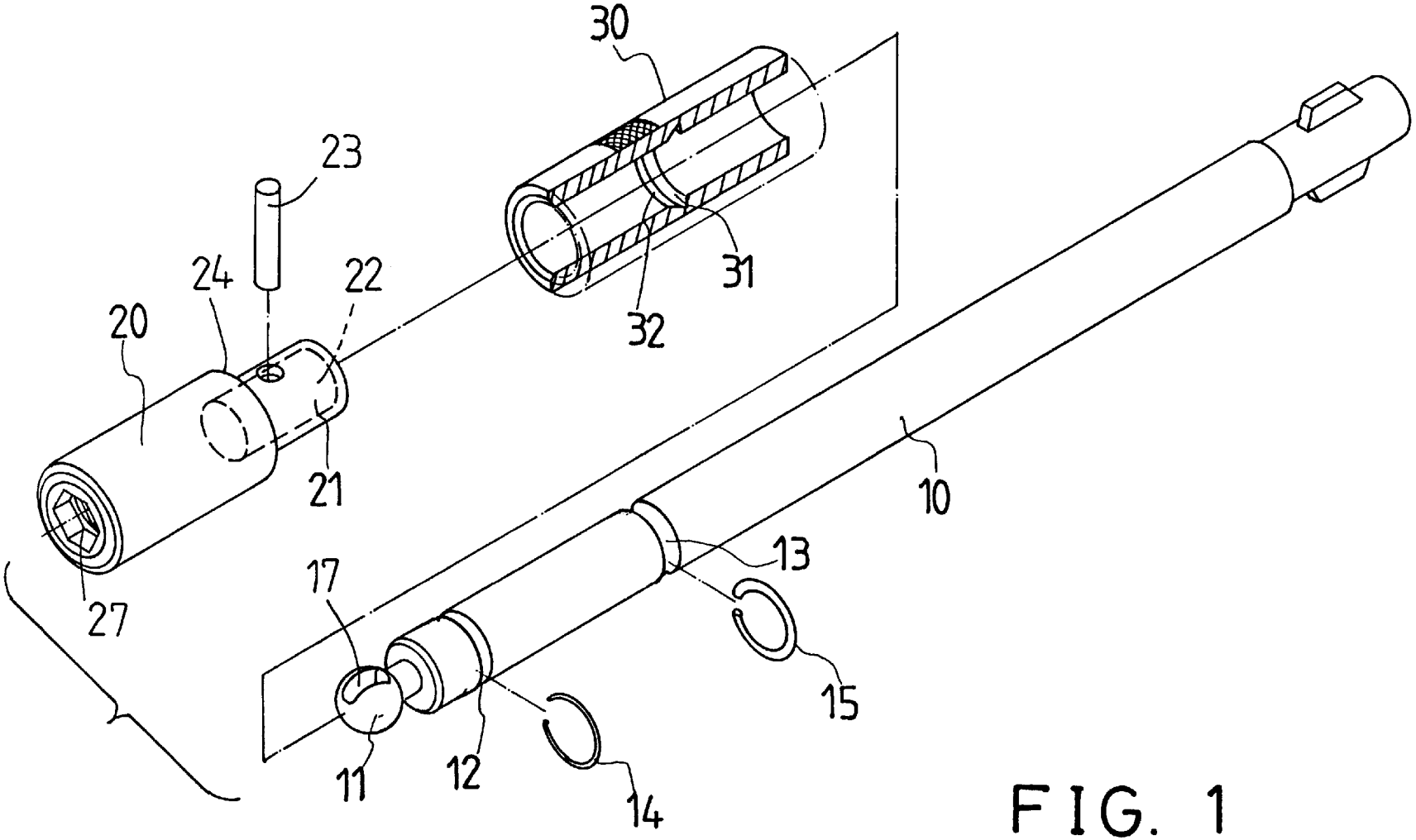
FIG. 1 is an exploded view of a tool in accordance with the present invention.
Figure 2:
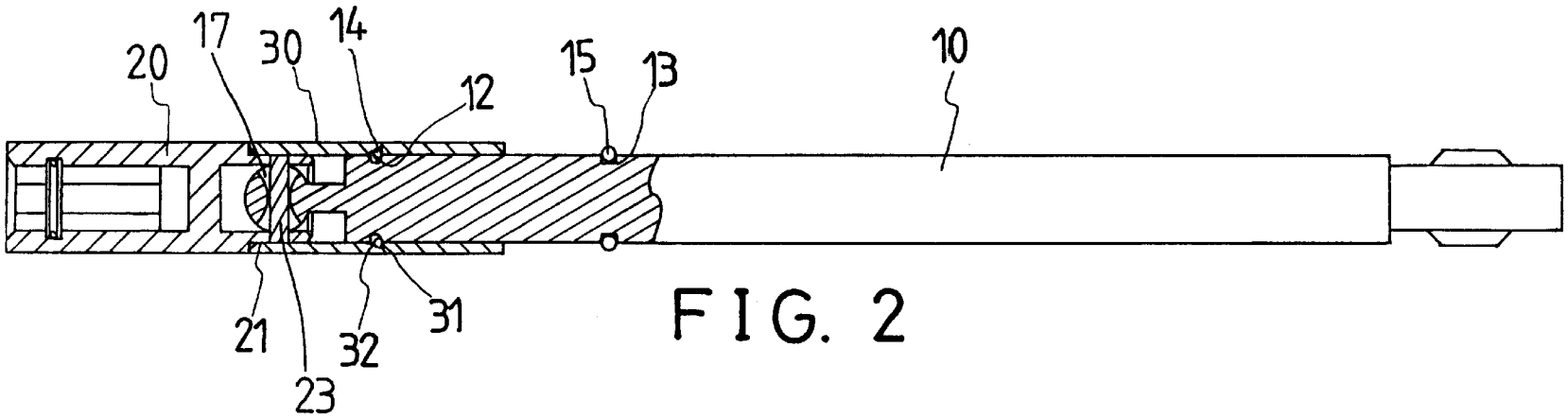
FIG. 2 is a cross sectional view of the tool, in which the driving head is locked to the handle or to the driving stem of the tool.
Figure 3:
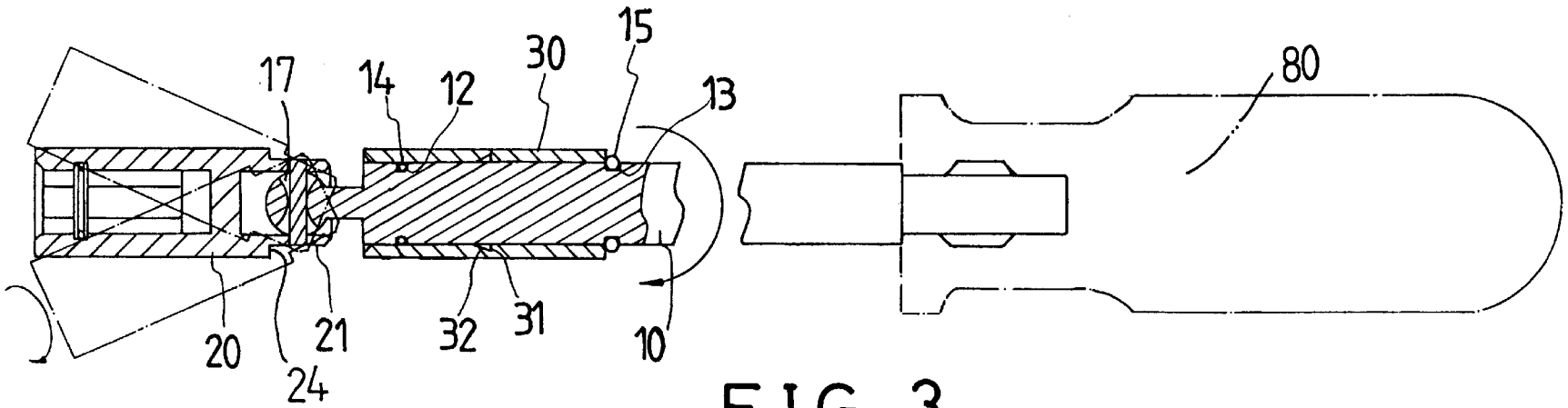
FIG. 3 is a cross sectional view of the tool, in which the driving head may be rotated relative to the handle or the driving stem of the tool.

Referring to the drawings, and initially to FIGS. 1–3, a tool in accordance with the present invention comprises a tool body 10 including one end for securing to a driving member 80 and including the other end having a spherical coupler 11 secured thereto. The tool body 10 may be a driving stem or a handle or a tool extension; and includes two annular grooves 12, 13 formed therein for receiving retaining rings 14, 15 respectively. The retaining ring 14 includes a size smaller than that of the other retaining ring 15 and is located closer to the pivotal coupler 11. The coupler 11 includes a channel 17 formed therein and having two enlarged end portions and having a narrower middle portion, best shown in FIGS. 2 and 3. A barrel 30 is slidably engaged on the tool body 10 and includes an annular recess 31 formed in the inner peripheral portion thereof and having a tapered surface 32 formed therein for allowing the retaining ring 14 to be easily engaged into and disengaged from the annular recess 31 of the barrel 30. The retaining ring 15 of greater size is provided for engaging with one end of the barrel 30 and for limiting the relative sliding movement of the barrel 30 on the tool body 10 and for preventing the barrel 30 from being disengaged from the tool body 10.

A driving head 20 includes one end 21 having a chamber 22 formed therein for receiving the coupler 11 which is preferably force-fitted in the one end 21 of the driving head 20 for allowing the driving head 20 to be secured to the tool body 10 at any required angular position. A pin 23 is secured in the one end 21 of the driving head 20 and is engaged through the chamber 22 of the driving head 20 and is engaged through the channel 17 of the coupler 11 for rotatably coupling the driving head 20 to the tool body 10 at the pivotal coupler 11 and for allowing the driving head 20 to be rotated relative to the tool body 10 by the rotating engagement of the pin 23 in the channel 17 of the coupler 11 (FIG. 3). It is preferable that the one end 21 of the driving head 20 includes a size smaller than that of the driving head 20 for defining an annular shoulder 24 in the driving head 20 and for engaging with the barrel 30 (FIG. 2) and for limiting the engagement of the barrel 30 onto the driving head 20. The driving head 20 includes an engaging opening 27 formed in the other end thereof for engaging with the fasteners or the tool extensions or the tool bits.

In operation, as shown in FIG. 2, when the barrel 30 is engaged onto the one end 21 of the driving head 20, the driving head 20 is locked to the tool body 10 and may not be rotated relative to the tool body 10 at this moment. The retaining ring 14 is engaged in the annular recess 31 of the barrel 30 at this time, for securing the barrel 30 to the tool body 10. As shown in FIG. 3, when the barrel 30 is slided away from the driving head 20 by disengaging the retaining ring 14 from the annular recess 31 of the barrel 30, the driving head 20 is allowed to rotate relative to the tool body 10 by the rotating engagement of the pin 23 in the channel 17 of the coupler 11.

Referring next to FIGS. 4–6, the annular grooves 12, 13 may be formed in the ends of the tool body 10, and the annular recess 31 may be formed in one end of the barrel 30 for engaging with the retaining rings 14, 15 that are engaged in the annular grooves 12, 13 respectively. The driving head 20 has no annular shoulder formed therein in this embodiment, and may include a partition 40 formed therein for separating the chamber 22 and the engaging opening 27 of the driving head 20 from each other. In operation, the tool bit 81 and the fastener 88 may either or both be received in the barrel 30. The driving head 20 may not be rotated relative to the tool body 10 when the barrel 30 is engaged onto the driving head 20 (FIG. 5), and may be rotated relative to the tool body 10 when the barrel 30 is disengaged from the driving head 20 (FIG. 6).

Accordingly, the tool in accordance with the present invention includes a quick release lock device for quickly locking and unlocking the rotatable driving head of the tool relative to the handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a) a tool body including a first end, b) a driving head-including a first end pivotally coupled to said first end of said tool body at a pivotal coupler, and c) a barrel slidably engaged on said tool body and slidable to engage onto said driving head to lock said driving head to said tool body and to prevent said driving head from rotating relative to said tool body about said pivotal coupler, and said driving head being allowed to be rotated relative to said tool body about said pivotal coupler when said barrel is disengaged from said driving head.

2. The tool according to claim 1, wherein said driving head includes a first end having a chamber formed therein, said pivotal coupler includes a spherical body extended from said first end of said tool body and rotatably received in said chamber of said driving head for allowing said driving head to be rotated relative to said tool body.

3. The tool according to claim 2, wherein said spherical body of said pivotal coupler includes a channel formed therein, said driving head includes a pin secured in said first end thereof and engaged through said channel of said pivotal coupler for rotatably securing said driving head to said tool body.

4. The tool according to claim 3, wherein said channel of said pivotal coupler includes two enlarged end portions and a narrower middle portion for receiving said pin and for allowing said pin to be rotated relative to said pivotal coupler.

5. The tool according to claim 1, wherein said driving head includes an annular shoulder formed therein for engaging with said barrel and for limiting a relative movement of said barrel to said driving head.

6. The tool according to claim 1, wherein said tool body includes a annular groove formed therein, and a retaining ring engaged on said annular groove of said tool body, said barrel includes an annular recess formed therein for receiving said retaining ring and for securing said barrel to said tool body.

7. The tool according to claim 6, wherein said barrel includes a tapered surface formed therein for engaging with said retaining ring and for facilitating an engagement and an disengagement of said retaining ring from said annular recess of said barrel.

8. The tool according to claim 1, wherein said tool body includes a annular groove formed therein, and a retaining ring engaged on said annular groove of said tool body and engaged with said barrel for limiting a relative movement of said barrel to said tool body.

* * * * *